US009238957B2

(12) United States Patent
Thurman

(10) Patent No.: US 9,238,957 B2
(45) Date of Patent: Jan. 19, 2016

(54) DOWNHOLE INJECTION ASSEMBLY HAVING AN ANNULAR ORIFICE

(71) Applicant: Halliburton Energy Services, Inc., Houston, TX (US)

(72) Inventor: Robert Lester Thurman, Frisco, TX (US)

(73) Assignee: Halliburton Energy Services, Houston, TX (US)

( * ) Notice: Subject to any disclaimer, the term of this patent is extended or adjusted under 35 U.S.C. 154(b) by 0 days.

(21) Appl. No.: 14/378,489

(22) PCT Filed: Jul. 1, 2013

(86) PCT No.: PCT/US2013/048962
§ 371 (c)(1),
(2) Date: Aug. 13, 2014

(87) PCT Pub. No.: WO2015/002635
PCT Pub. Date: Jan. 8, 2015

(65) Prior Publication Data

US 2015/0226048 A1 Aug. 13, 2015

(51) Int. Cl.

| | |
|---|---|
| ***E21B 43/24*** | (2006.01) |
| ***E21B 43/32*** | (2006.01) |
| ***E21B 17/18*** | (2006.01) |
| ***E21B 43/12*** | (2006.01) |

(52) U.S. Cl.
CPC ..... *E21B 43/24* (2013.01); *E21B 17/18* (2013.01); *E21B 43/121* (2013.01); *E21B 43/32* (2013.01)

(58) Field of Classification Search
CPC ..... E21B 17/18; E21B 43/24; E21B 43/121; E21B 43/25; E21B 43/124
See application file for complete search history.

(56) References Cited

U.S. PATENT DOCUMENTS

| | | | | |
|---|---|---|---|---|
| 3,863,719 | A | 2/1975 | Parker | |
| 4,440,218 | A | 4/1984 | Farley | |
| 4,648,455 | A * | 3/1987 | Luke | 166/303 |
| 4,921,044 | A * | 5/1990 | Cooksey | 166/116 |
| 6,491,097 | B1 * | 12/2002 | Oneal et al. | 166/278 |
| 6,708,763 | B2 * | 3/2004 | Howard et al. | 166/303 |
| 7,350,577 | B2 * | 4/2008 | Howard et al. | 166/303 |
| 7,631,694 | B2 * | 12/2009 | Struyk et al. | 166/272.3 |
| 7,793,716 | B2 * | 9/2010 | Macias et al. | 166/236 |
| 9,027,642 | B2 * | 5/2015 | Sladic et al. | 166/263 |
| 2003/0173086 | A1 * | 9/2003 | Howard et al. | 166/305.1 |
| 2007/0246226 | A1 * | 10/2007 | Macias et al. | 166/386 |
| 2008/0169095 | A1 * | 7/2008 | Struyk et al. | 166/250.06 |

(Continued)

FOREIGN PATENT DOCUMENTS

WO 2005078235 8/2005

OTHER PUBLICATIONS

International Search Report and Written Opinion dated Mar. 31, 2014 for Application No. PCT/US2013/048962.

*Primary Examiner* — Jennifer H Gay
(74) *Attorney, Agent, or Firm* — Haynes and Boone, LLP

(57) ABSTRACT

A downhole injection apparatus having a sleeve disposed in a tubular housing. The sleeve and housing define an annular orifice through which steam flows prior to injection into the wellbore. Water condensate collects at the orifice or restriction proximate the orifice and is mixed with or entrained into the flow of steam. The sleeve preferably has a plurality of generally radial ports such that steam flows from interior the sleeve to the annulus. Preferably the injection ports and sleeve ports are angled to reduce or eliminate radical changes in direction of the steam flow.

4 Claims, 3 Drawing Sheets

(56) References Cited

U.S. PATENT DOCUMENTS

| | | | | |
|---|---|---|---|---|
| 2009/0194293 | A1 | 8/2009 | Stephenson et al. | |
| 2012/0048569 | A1 | 3/2012 | Williams | |
| 2012/0298356 | A1 * | 11/2012 | Sladic et al. | 166/263 |
| 2015/0034333 | A1 * | 2/2015 | Fripp et al. | 166/373 |

* cited by examiner

DOWNHOLE INJECTION ASSEMBLY HAVING AN ANNULAR ORIFICE

CROSS-REFERENCE TO RELATED APPLICATIONS

None.

FIELD OF INVENTION

The inventions relate, in general, to equipment utilized in conjunction with operations performed in subterranean wells and, in particular, to injection of compressible fluids, such as steam, into a subterranean formation and methods and apparatus for performing the same.

BACKGROUND OF INVENTION

Without limiting the scope of the present invention, its background will be described with reference to producing fluid from a hydrocarbon bearing subterranean formation, as an example. During development of a well traversing a hydrocarbon-bearing subterranean formation, various operations are typically performed and various equipment run-in and pulled from the wellbore. Treatment of a wellbore can include the injection of fluids into the formation, and in particular, the injection of steam or other heated fluid from a work string into the wellbore annulus.

Artificial lifting techniques are used where formations lack adequate pressure to cause hydrocarbons to rise to the surface. Pumps can be used in the wellbore or at the surface to bring fluids to the surface. Gas can be injected into the wellbore to lighten the weight of fluids and facilitate their movement towards the surface. In other instances, a compressible fluid, like pressurized steam, is injected into adjacent wellbores to urge hydrocarbons towards a producing wellbore. The steam, through heat and pressure, reduces the viscosity of the oil and urges it towards a production wellbore. Injection operations are known in the industry and not described in detail here. Selective injection along various intervals of the wellbore is often accomplished with selectively openable valves, such as sliding sleeve valves, and the like, and often in conjunction with isolation devices such as packers, plugs, bridge plugs and the like.

During injection operations, steam (water and vapor) can be lost prior to injection as it condenses into liquid (water). Most water loss occurs along the surfaces of the tubulars through which the steam is injected. Additional losses occur at ports and passageways, especially where the steam must change direction of flow at a sharp angle. Consequently, an operator may inadvertently inject an undesired ratio of water and vapor at a given interval. Further, the condensate water tends to collect near the far end of the injection string, resulting in a high vapor content injection uphole and a low vapor injection content downhole.

Attempts have been made to limit condensation, entrain condensate water back into the steam flow, and to manage water to vapor ratio. For example, it has been suggested that fluid flow be routed through various sizes and arrangements of ports, selectively openable valves, nozzles, throats and diffusers, or that the injection fluid flow be pulsed, oscillated, and modified from axial to rotational patterns. For further disclosure regarding steam injection, see the following references, each of which is incorporated herein by reference in their entirety for all purposes: U.S. Pat. No. 6,708,763 to Howard et al., U.S. Pat. No. 7,032,675 to Steele et al., U.S. Pat. No. 7,909,094 to Schultz et al., U.S. Pat. No. 6,158,510 to Bacon et al., U.S. Pat. No. 7,367,399 to Steele at al., and U.S. Pat. No. 5,607,018 to Schuh. Further, commercial tools are available from Halliburton Energy Services, Inc., such as the Zonemaster (trade name) Injection System.

However, condensation and its control remain a concern. Accordingly, a need exists for a downhole injection tool and method of use to reduce and control condensation.

BRIEF DESCRIPTION OF THE DRAWING

For a more complete understanding of the features and advantages of the present invention, reference is now made to the detailed description of the invention along with the accompanying Figures in which corresponding numerals in the different Figures refer to corresponding parts and in which.

It should be understood by those skilled in the art that the use of directional terms such as above, below, upper, lower, upward, downward and the like are used in relation to the illustrative embodiments as they are depicted in the Figures, the upward direction being toward the top of the corresponding Figure and the downward direction being toward the bottom of the corresponding Figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
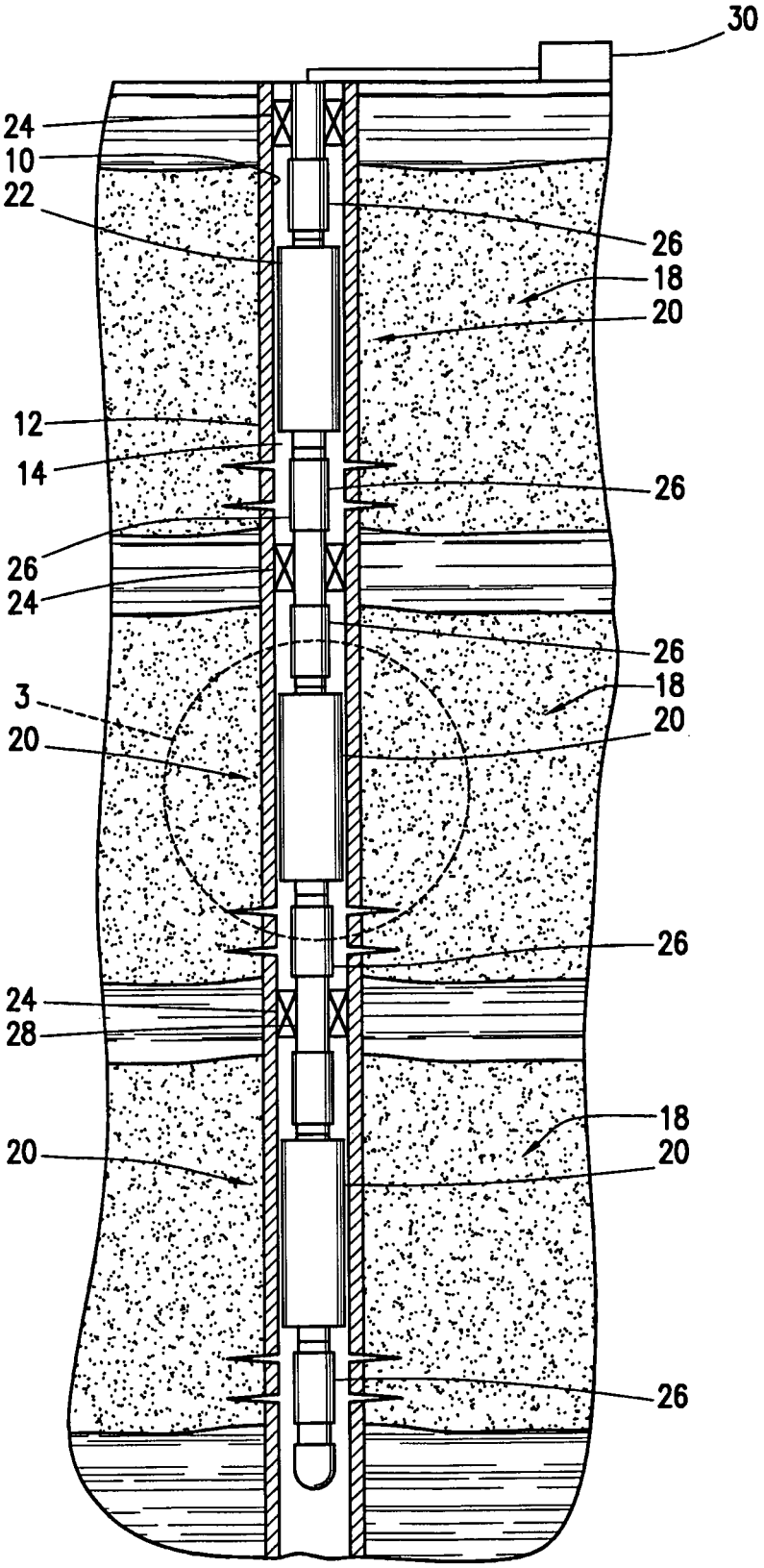
FIG. 1 is a schematic illustration of a well system having an exemplary embodiment of apparatus disposed therein according to an aspect of the present invention.

Referring to FIG. 1, a well system is depicted illustrating a wellbore 10 and an exemplary embodiment of an apparatus 20 disposed therein according to an aspect of the present invention. A tubing string 22 is coaxially disposed in the wellbore 10 which has a casing 12 cemented (not shown) in the wellbore. "Tubing string" is used generically and includes injection, work, production, and other types of jointed or coiled tubing strings. An annular space 14 is defined between the tubing string and the casing or wellbore. The typical tubing string 22 includes various packers 24, connectors 26, spacers 28, valves, and other equipment and tools, as is known in the art. The exemplary apparatus 20 is positioned along the tubing string 22 adjacent selected perforated intervals of the casing 12 corresponding to zones 18 of the formation to be injected. The zones are shown isolated by packers. In use, the apparatus 20 delivers steam (water and vapor) from a source 30 at the surface to the target zones. The wellbore is illustrated as vertical, but it is understood that the wellbore can be horizontal, deviated, etc., as known in the art.

Figure 2:
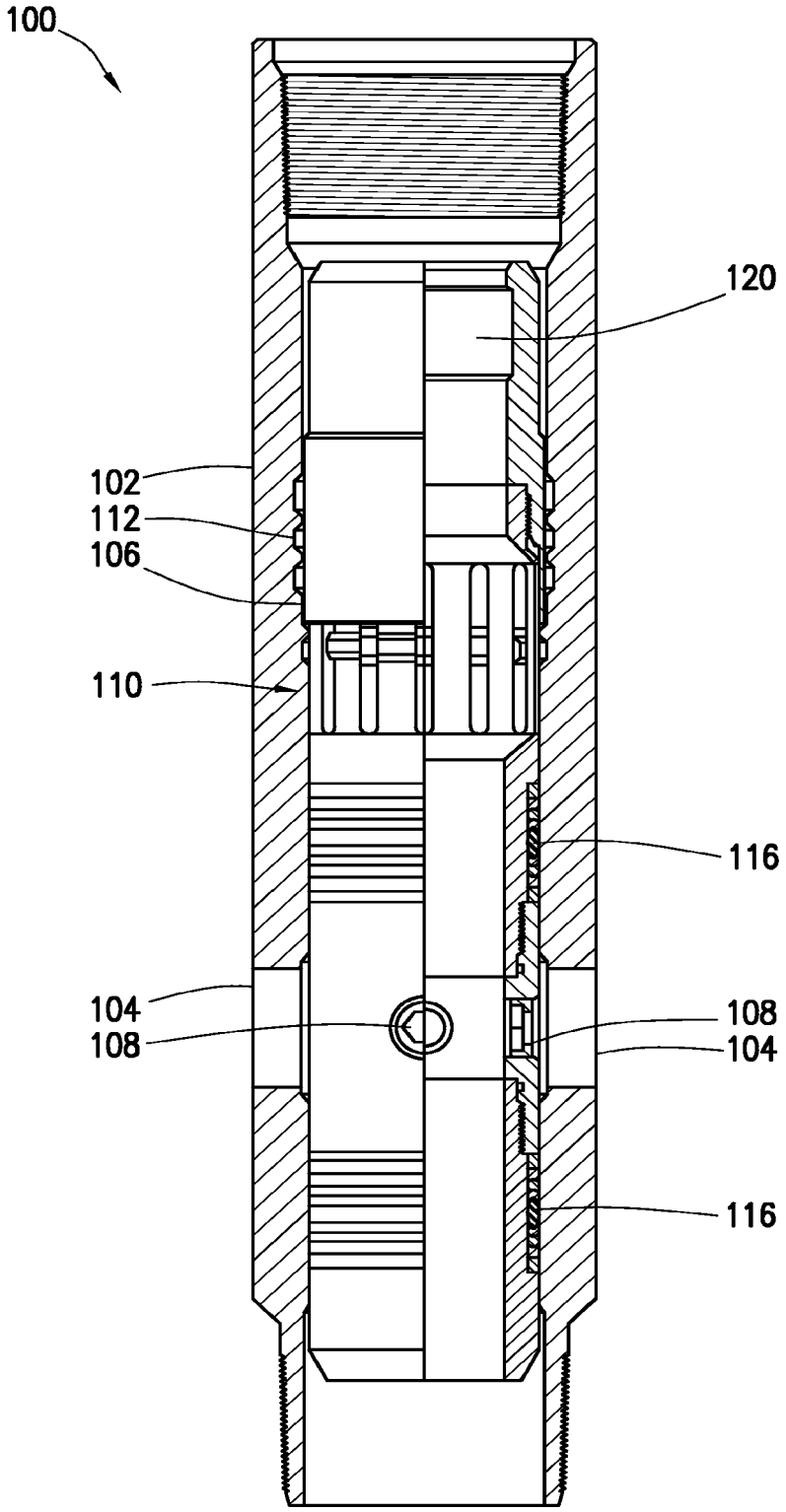
PRIOR ART FIG. 2
FIG. 2 is a partial cross-sectional schematic view of an embodiment of an injection tool for purposes of discussion.

FIG. 2 is a partial cross-sectional schematic view of an embodiment of an injection tool for purposes of discussion. The illustrated prior art device 100 is similar to a commercially available system from Halliburton Energy Services, Inc. A landing nipple 102 having a plurality of injection ports 104 is generally run as part of the tubing string and is used as the injection point into the production tubing, wellbore annulus, and/or formation zone. Isolation valve sleeves can be installed and used to selectively inject a desired zone. An injection tubular 106 is positioned in the landing nipple 102. The injection tubular 106, shown in partial cross-section, has injection ports 108 corresponding to the landing nipple ports 104. A collet assembly 110 cooperates with detents 112 defined on the interior wall of the nipple. Annular pressure seals or packing stacks 116 are positioned above and below the injection ports 108 and provide annular pressure sealing between the injection tubular and nipple. Steam or other injected compressible fluid is transported downhole through central passageway 120 and radially outward through ports 104 and 108. The ports 108 can have nozzles or other fluid restrictors or regulators.

Figure 3:
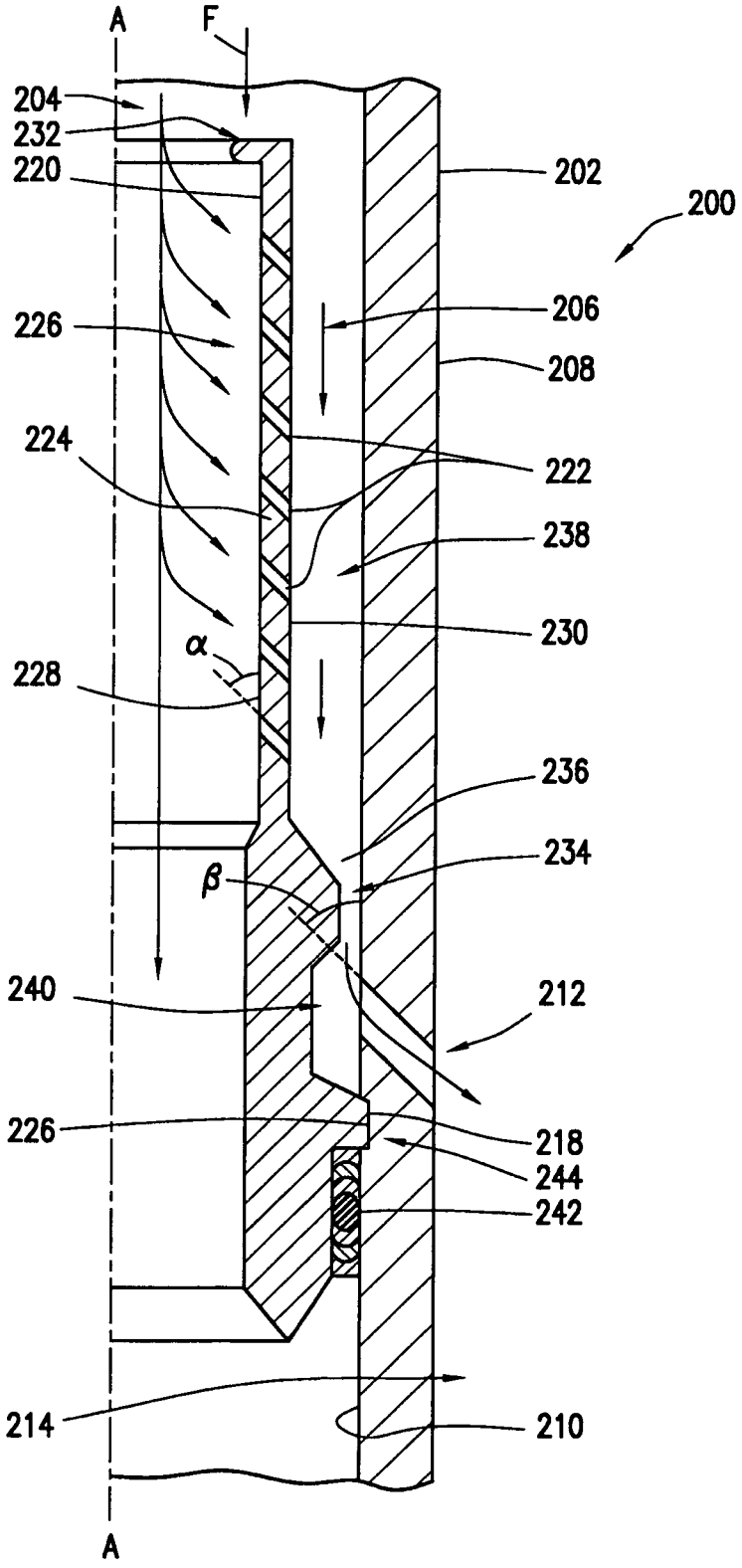
FIG. 3 is a cross-sectional schematic view of an exemplary embodiment according to an aspect of the invention.

FIG. 3 is a cross-sectional schematic view of an exemplary embodiment according to an aspect of the invention. An injection assembly 200 is depicted having a substantially tubular housing 202 and an injection tubular or sleeve 220.

The housing 202 can be part of a tubing string, landing nipple, or other apparatus, or can be attached to connectors, spacers, extension joints, etc. Steam (water and vapor) or other compressible fluid, F, is provided through interior passageway 204. The passageway 204 extends along the tubing string and can have various radial dimensional variations, flow regulation devices, etc., as are known in the art. The flow path is split in the illustrated embodiment such that a portion of the fluid flows through the interior passageway 204 and past the injection sleeve 220, while a portion of the fluid flows into annulus 206 defined between the tubular housing 202 and the injection sleeve 220.

The housing 202 has a housing wall 208 with a generally cylindrical interior surface 210. A plurality of injection ports 212 are defined extending generally radially therethrough. The injection ports 212 provide fluid communication between the annulus 206, which is defined between the injection sleeve 220 and housing 202, and the exterior of the housing such as, for example, the wellbore annulus 214. The injection ports 212 are disposed at an angle β with respect to the longitudinal axis, A, of the assembly 200 generally and the sleeve 220. The angle β is preferably less than 90 degrees with respect to the longitudinal axis A, however, the disclosure includes embodiments having the ports 212 at any angle. The preferred embodiment ports 212 are angled to provide a flow path for steam (water and vapor) and condensate without abrupt change in direction. Preferably the ports are angled such that angle β is 60 degrees or less, and more preferably 45 degrees or less.

The housing 202 can have various internal and external profiles and features for cooperation with the injection sleeve, tubing sections above and below, and other downhole tools run into the housing. For example, the interior surface 210 in a preferred embodiment includes a profile 218 which cooperates with a corresponding profile 226 on the exterior surface of the injection sleeve 220 to form connection 244. The profiles cooperate to maintain selected positioning of the sleeve and housing with respect to one another. Alternately or in combination, the sleeve and housing can be attached by other means known in the art, including snap ring, extendable or spring-loaded members, etc.

The injection sleeve 220 is positioned interior to the housing 202. The annulus 206 is defined between sleeve 220 and housing 202 and preferably has a generally annular opening at the upper end of the sleeve such that steam or other injected fluid flows directly into the annulus from the passageway 204. Additionally, the injection sleeve 220 has a plurality of radially extending ports 222 defined through the sleeve wall 224 and providing fluid communication from the interior passageway 204 to the annulus 206. Note that the ports 222 are generally parallel to one another, and are disposed at an angle α with respect to the longitudinal axis, A, of the assembly 200 generally and the sleeve 220. The angle α is not perpendicular to the axis A. Instead the ports are angled to provide a flow path for steam (water and vapor) and condensate without abrupt change in direction. Preferably the ports are angled such that angle α is 60 degrees or less, and more preferably 45 degrees or less. The extended fishneck provides a relatively narrow annulus 206 between the sleeve and the housing and has multiple holes 222 allowing free transfer of steam and condensed water between the interior passageway 204 and annulus 206.

The sleeve 220 further includes an extended "fishneck" 226, that is, an elongated, substantially tubular, portion of the sleeve extending above the injection port 212 and along which steam flows, both on the interior and exterior surfaces, 228 and 230, respectively. The upper end of the fishneck can define an attachment mechanism 232 in a preferred embodiment, such that the sleeve can be removed from and inserted into the housing. Alternate mechanisms will be recognized by those of skill in the art.

The sleeve 220 defines an outer diameter (OD) which varies along the length of the sleeve. The exterior surface of the sleeve 220 and the interior surface 210 of the housing 202 define an annular orifice 234 positioned longitudinally below the plurality of sleeve radial ports 222 and above the injection port 212.

The annular orifice extends circumferentially about the sleeve and interior the housing. The annular orifice is defined between the sleeve outer diameter (OD) and the housing inner diameter (ID). The annular orifice 234 is narrower than the upper annular chamber 238 defined between the fishneck and the housing. The disclosed device provides a single annular orifice, as contrasted with a plurality of cylindrical nozzles or passageways, through which steam (and condensate) flows prior to injection. This provides advantages over prior art devices, including a providing a larger total restriction area, a corresponding potentially larger amount of total collected condensate at the orifice, and the orifice does not require a change of fluid flow to a plurality of narrow passageways and the often severe direction changes which typically accompany such division of fluid flow. These features result in less water condensation than other injection devices since the steam flow has fewer apertures and passageways to go through, resulting in less flow disruption, and encounters fewer "walls" on which water can condense. If properly profiled, the annular orifice provides a restriction which increases velocity, keeping water entrained while causing a pressure drop to suction condensed water into the steam flow.

The sleeve and housing define two annular chambers, an upper annular chamber 238 which receives fluid upstream of the annular orifice 234, and a lower annular chamber 240 which receives fluid from the orifice 234. The annular upper chamber 238 is discussed above and extends longitudinally along annulus 206 from the upper end of the fishneck 220 to the upper end of the orifice 234. The lower chamber 240 is wider than the annular orifice and is in fluid communication with the orifice and the injection port 212. Fluid is prevented from passing longitudinally below the lower chamber by packing stack or seal(s) 242, connection 244, etc.

The dimensions of the annular orifice are selected and selectable to optimize entrainment of condensate into the steam flow prior to injection. Since the orifice is narrower than the chamber above, condensate will collect at the narrowing or restriction 236. The orifice restriction 236 produces an increase in fluid velocity and a decrease in pressure, resulting in improved mixing and entrainment of condensed water with the steam.

Note that the restriction area also defines an annular space. The dimensions (width and length) of the orifice, the restriction area, the chamber above, and the chamber below can all be selected and incorporated into the sleeve design. Since the ideal dimensions differ depending on various operational conditions, such as temperature, pressure, steam content, fluid type, water to vapor ratio, etc., the system is designed such that the sleeve can be removed and replaced with other sleeves of different dimensions and configuration based on the expected operational conditions. The orifice is adjustable by interchanging sleeves having varying dimensions and configurations.

The disclosed system is capable of remixing and injecting captured condensed water with injection steam. Additionally, due to angled injection ports, the steam and condensate mixture is not required to make a radical turn (90 degrees) from the interior passageway at the orifice restriction point.

The design disclosed herein eliminates the need for a plurality of fluid orifices made up, for example, to the circumference of the housing. Instead, an annular restriction is provided between the sleeve OD and nipple housing ID above the injection ports. The annular area defined between the nipple ID and insert sleeve OD defines the annular orifice above the injection ports. The sleeve of the disclosed design is removable and replaceable, providing an easy method of on-site exchange of sleeves having selected annular orifice areas and other dimensions.

In the preferred and exemplary methods presented herein and in the appended claims, various method steps are disclosed, where the steps listed are not exclusive, can sometimes be skipped, or performed simultaneously, sequentially, or in varying or alternate orders with other steps (i.e., steps XYZ can be performed as XZY, YXZ, YZX, ZXY, etc.) (unless otherwise indicated), and wherein the order and performance of the steps is disclosed additionally by the claims appended hereto, which are incorporated by reference in their entirety into this specification for all purposes (including support of the claims) and/or which form a part of this specification, the method steps presented in the following text. Exemplary methods of use of the invention are described, with the understanding that the invention is determined and limited only by the claims. Those of skill in the art will recognize additional steps, different order of steps, and that not all steps need be performed to practice the inventive methods described.

Various methods for servicing a subterranean wellbore extending through a formation are provided. 14) The methods comprise the steps of: positioning at a downhole location an apparatus having a substantially tubular housing and a sleeve positioned therein and attached thereto, an annulus defined between the housing and sleeve; flowing a fluid into the annulus and longitudinally through the sleeve; collecting condensate from the fluid proximate an annular orifice defined between the sleeve and housing; flowing the fluid through the annular orifice; mixing at least a portion of the condensate and the fluid; and flowing the resulting mixture from the annulus to the exterior of the housing. 15) The methods disclosed at 14) include wherein the fluid is steam and the condensate is water. 16) The methods disclosed at 14-15, can further comprise the step of flowing the fluid through a plurality of injection ports extending through the housing. 17) The methods disclosed at 14-16, can further comprise the step of flowing the fluid from a passageway defined on the interior of the sleeve, through a plurality of sleeve ports extending generally radially through the sleeve, and into the annulus. 18) The methods disclosed at 16-17, wherein at least some of the sleeve ports or some of the injection ports are disposed at an angle of 45 degrees or less with respect to a longitudinal axis of the housing. 19) The methods disclosed at 14-18, can further comprise the steps of, before the first step, inserting the sleeve into the housing and attaching the sleeve to the housing. 20) The methods disclosed at 14-19, can further comprise the step of, after the last step, pulling the housing and sleeve from the wellbore. 21) The methods disclosed at 14-20, can further comprise the step of detaching the sleeve from the housing. 22) The methods disclosed at 14-21, can further comprise the step of replacing the sleeve with a replacement sleeve, the replacement sleeve defining a replacement annular orifice of different dimensions than the annular orifice.

It is to be understood that use of directional terms such as above, below, upper, lower, upward, downward, left, right, uphole, downhole and the like are used primarily in relation to the illustrative embodiments as depicted in the Figures unless context requires otherwise. Uphole refers to the direction of or towards the surface of the well, and downhole refers to the direction of or towards the toe of the well.

The words or terms used herein have their plain, ordinary meaning in the field of this disclosure, except to the extent explicitly and clearly defined in this disclosure or unless the specific context otherwise requires a different meaning.

If there is any conflict in the usages of a word or term in this disclosure and one or more patent(s) or other documents that may be incorporated by reference, the definitions that are consistent with this specification should be adopted.

The words "comprising," "containing," "including," "having," and all grammatical variations thereof are intended to have an open, non-limiting meaning. For example, a composition comprising a component does not exclude it from having additional components, an apparatus comprising a part does not exclude it from having additional parts, and a method having a step does not exclude it having additional steps. When such terms are used, the compositions, apparatuses, and methods that "consist essentially of" or "consist of" the specified components, parts, and steps are specifically included and disclosed. As used herein, the words "consisting essentially of," and all grammatical variations thereof are intended to limit the scope of a claim to the specified materials or steps and those that do not materially affect the basic and novel characteristic(s) of the claimed invention.

The indefinite articles "a" or "an" mean one or more than one of the component, part, or step that the article introduces.

Whenever a numerical range of degree or measurement with a lower limit and an upper limit is disclosed, any number and any range falling within the range is also intended to be specifically disclosed. For example, every range of values (in the form "from a to b," or "from about a to about b," or "from about a to b," "from approximately a to b," and any similar expressions, where "a" and "b" represent numerical values of degree or measurement) is to be understood to set forth every number and range encompassed within the broader range of values.

Terms such as "first," "second," "third," etc. may be assigned arbitrarily and are merely intended to differentiate between two or more components, parts, or steps that are otherwise similar or corresponding in nature, structure, function, or action. For example, the words "first" and "second" serve no other purpose and are not part of the name or description of the following name or descriptive terms. The mere use of the term "first" does not require that there be any "second" similar or corresponding component, part, or step. Similarly, the mere use of the word "second" does not require that there be any "first" or "third" similar or corresponding component, part, or step. Further, it is to be understood that the mere use of the term "first" does not require that the element or step be the very first in any sequence, but merely that it is at least one of the elements or steps. Similarly, the mere use of the terms "first" and "second" does not necessarily require any sequence. Accordingly, the mere use of such terms does not exclude intervening elements or steps between the "first" and "second" elements or steps, etc.

While this invention has been described with reference to illustrative embodiments, this description is not intended to be construed in a limiting sense. Various modifications and combinations of the illustrative embodiments as well as other embodiments of the invention, will be apparent to person skilled in the art upon reference to the description. It is, therefore, intended that the appended claims encompass any such modifications or embodiments.

It is claimed:

1. A downhole apparatus for positioning in a wellbore extending through a subterranean formation, the apparatus comprising:

a tubular housing defining a first interior passageway and having a plurality of injection ports providing fluid communication between the first interior passageway and the wellbore;

a tubular sleeve defining a second interior passageway and positioned in the housing such that an annulus is defined between the sleeve and the housing, the annulus having an annular opening located at an upper end of the sleeve; and an annular orifice positioned within the annulus and upstream of the injection ports;

wherein the tubular sleeve comprises an elongated portion extending upstream of the annular orifice such that an annular chamber is defined between the elongated portion of the sleeve and the housing, the elongated portion having a plurality of sleeve ports providing fluid communication between the second interior passageway annulus; and wherein the first and second interior passageways are in fluid communication with the annular chamber via the plurality of sleeve ports and the annular opening.

2. The downhole apparatus of claim 1, wherein the plurality of sleeve ports are disposed at an angle of 45 degrees or less with respect to a longitudinal axis of the apparatus.

3. A method for servicing a subterranean wellbore extending through a formation, the method comprising the steps of:

a) positioning at a downhole location an apparatus comprising a tubular housing defining a first interior passageway and a sleeve defining a second interior passageway, the sleeve being positioned in the housing and attached thereto such that an annulus is defined between the housing and the sleeve, the annulus having an annular opening located at an upper end of the sleeve;

b) flowing a fluid from the first and second interior passageways into the annulus via the annular opening and a plurality of ports formed through the sleeve;

c) collecting condensate from the fluid proximate an annular orifice defined between the sleeve and housing;

d) flowing the fluid through the annular orifice;

e) mixing at least a portion of the condensate and the fluid; and f) flowing the resulting mixture from the annulus to the exterior of the housing.

4. The method of claim 3, wherein the fluid is steam and the condensate is water.

* * * * *